US006540318B1

(12) United States Patent
Ikeda

(10) Patent No.: US 6,540,318 B1
(45) Date of Patent: Apr. 1, 2003

(54) LIQUID DETECTION METHOD AND APPARATUS THEREFOR, INK-JET PRINTING APPARATUS, AND INK DETECTION METHOD FOR THE INK-JET PRINTING APPARATUS

(75) Inventor: Tetsuhito Ikeda, Machida (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/544,166

(22) Filed: Apr. 6, 2000

(30) Foreign Application Priority Data

Apr. 7, 1999 (JP) ..... 11-100494

(51) Int. Cl.[7] ..... B41J 2/01
(52) U.S. Cl. ..... 347/19
(58) Field of Search ..... 347/14, 17, 19

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 5,508,722 A | * | 4/1996 | Saito et al. | 347/17 |

FOREIGN PATENT DOCUMENTS

| | | |
|---|---|---|
| JP | 54-056847 | 8/1979 |
| JP | 59-123670 | 7/1984 |
| JP | 59-138461 | 8/1984 |
| JP | 60-071260 | 4/1985 |
| WO | 9100807 | 1/1991 |

* cited by examiner

*Primary Examiner*—Craig Hallacher
(74) *Attorney, Agent, or Firm*—Fitzpatrick, Cella, Harper & Scinto

(57) ABSTRACT

Detection of whether or not liquid or a liquid droplet (ink) has passed is realized without contacting the passing liquid or liquid droplet, by providing a radiated-wave detector, arranged near the liquid or liquid droplet, for detecting an infrared ray radiated from the passing liquid or liquid droplet, and a detector for detecting variation of an output value of the radiated-wave detector. Furthermore, the variation of an output value detected by the detector is integrated to obtain the variation amount of the output values, thereby obtaining the amount of liquid or liquid droplet (ink) passed. With the use of the foregoing configuration, further provided is an ink-jet printing apparatus which can accurately determine whether or not ink has been discharged by a printhead and which can measure the amount of ink discharged without contacting the ink, and an ink detection method for the ink-jet printing apparatus.

47 Claims, 10 Drawing Sheets

LIQUID DETECTION METHOD AND APPARATUS THEREFOR, INK-JET PRINTING APPARATUS, AND INK DETECTION METHOD FOR THE INK-JET PRINTING APPARATUS

FIELD OF THE INVENTION

The present invention relates to a liquid detection method and apparatus therefor for detecting, without contacting liquid or a liquid droplet, whether or not liquid or a liquid droplet has passed or detecting the amount of liquid passed, an ink-jet printing apparatus which detects ink discharged by an ink-jet head without contacting the ink, and an ink detection method for said ink-jet printing apparatus.

BACKGROUND OF THE INVENTION

Recently, printing apparatuses, employing an ink-jet method which performs printing by discharging ink onto a printing medium, are widely utilized owing to its ease of use.

In general, an ink-jet printing apparatus employs an ink-jet head having discharge orifices for discharging ink and discharge-energy generators for generating energy to discharge ink, and performs printing by driving the discharge-energy generators in accordance with print data and discharging ink droplets onto a printing medium. For the discharge-energy generators, a heating device for applying heat energy to ink, or a piezoelectric device which applies mechanical pressure is known. When a heating device is utilized as the discharge-energy generator, for instance, a heater for discharging is provided inside a nozzle, which is connected to a discharge orifice, so that the heat generated by the heater causes rapid bubble generation in the ink and pressure of the bubbles causes to discharge ink from the discharge orifice of the nozzle end.

The printing apparatus, employing the above-described ink-jet method, has been facing a problem of bubbles being gradually generated in ink inside the nozzle as time lapses or due to continuous printing operation because of gas dissolved in the ink, and resulting in ink discharge failure causing printing errors. Furthermore, ink inside the nozzle coagulates as time lapses, and the nozzle clogs, resulting in printing errors due to ink discharge failure in an image printing operation.

In order to solve such problems, recovery processing is performed for resolving discharge failure and recovering the discharging state by, for instance, sucking ink inside the nozzle from outside the ink-jet head at predetermined time intervals or at times when an ink discharge failure is detected. However, when recovery operation is performed, a large amount of ink is discharged without being used for printing, consequently wasting ink. Moreover, even if the recovery operation is performed, there is no guarantee that discharge failure will not occur again. Furthermore, if discharge failure is caused by a damaged discharge-energy generator, recovery operation cannot resolve the discharge failure.

A known method for solving the foregoing problems of ink discharge failure is to detect a nozzle causing ink discharge failure, i.e., a nozzle which does not discharge ink despite driving the discharge-energy generators of the nozzle, and perform recovery processing on that nozzle, so as to reduce the amount of ink consumption compared to the case of performing recovering processing on all nozzles. Another known method is to perform printing operation to compensate the area where printing was not performed due to ink discharge failure. As a method for detecting a nozzle causing ink discharge failure, an optical detection method, employing a light emission device and photoreceptor, is known. According to the optical detection method, ink is discharged across a light path, which extends from the light emission device to the photoreceptor, and when it is determined based on the output of the photoreceptor that the light path is intercepted by an ink droplet, normal ink discharge is determined. Since this optical detection method can perform detection without contacting the discharged ink droplet, cumbersome operation or a structure for removing attached ink is not necessary compared to other detection methods which require a contact with ink. In addition, since the detection precision of the detection portion does not deteriorate, this optical detection method is effective.

However, along with the recent improvement in printing density, the ink droplet discharged by each nozzle of an ink-jet printhead has become small. Therefore, in the aforementioned conventional optical detection method, the proportion of the amount of light, intercepted by a discharged ink droplet, to the total amount of light, emitted by the light emission device and reached the photoreceptor, is small. As a result, sufficient detection precision cannot be achieved.

SUMMARY OF THE INVENTION

The present invention has been proposed to solve the above-described conventional problems, and has as its object to provide a liquid detection method and apparatus therefor for detecting with high precision whether or not liquid or a liquid droplet has passed, or detecting the amount of liquid passed, without contacting the liquid or liquid droplet.

Furthermore, another object of the present invention is to provide an ink-jet printing apparatus which can accurately detect, without contacting ink, existence/absence of ink or the amount of ink in the path of ink discharged by a printhead, and an ink detection method for said ink-jet printing apparatus.

In order to achieve the above-described objects, a liquid detection apparatus according to the present invention has the following configuration.

More specifically, the liquid detection apparatus comprises: radiated wave detection means, arranged near passing liquid or a liquid droplet, for detecting a radiated wave radiated from the liquid or the liquid droplet and outputting a signal corresponding to the detected radiated wave; and detection means for detecting variation of the signal from said radiated wave detection means, wherein whether or not the liquid or the liquid droplet has passed is detected without contacting the passing liquid or the liquid droplet.

Furthermore, in order to achieve the above-described objects, a liquid detection method according to the present invention has the following configuration.

More specifically, whether or not liquid or a liquid droplet has passed is detected without contacting the passing liquid or the liquid droplet, by providing a sensor, detecting a radiated wave radiated from the liquid or the liquid droplet, near the passing liquid or the liquid droplet and detecting variation of an output value of the sensor.

Furthermore, in order to achieve the above-described objects, an ink-jet printing apparatus according to the present invention has the following configuration.

More specifically, the ink-jet printing apparatus for printing an image by discharging ink onto a printing medium with an ink-jet head, comprises: radiated wave detection means for detecting a radiated wave radiated from the ink discharged by the ink-jet head and outputting a signal corresponding to the detected radiated wave; and detection means for detecting variation of the signal from said radiated wave detection means, wherein whether or not the ink has passed is detected without contacting the ink.

Furthermore, in order to achieve the above-described objects, an ink detection method for an ink-jet printing apparatus according to the present invention has the following steps.

More specifically, the ink detection method for an ink-jet printing apparatus which prints an image by discharging ink onto a printing medium with an ink-jet head, comprises: a radiated wave detection step of detecting a radiated wave radiated from the ink discharged by the ink-jet head and outputting a value corresponding to the detected wave; and a detection step of detecting variation of the value detected in said radiated wave detection step, wherein whether or not the ink has passed is detected without contacting the ink.

According to an aspect of the present invention, the radiated wave is an infrared ray, and the detection means includes an infrared ray sensor.

Furthermore, it is preferable to include measurement means which measures a variation amount of the signal, detected by said detection means, by integrating the values of the signals.

Furthermore, whether or not liquid or a liquid droplet has been discharged is determined by determining a matching state between a pattern, represented by the variation detected by said detection means, and a predetermined pattern with which the liquid or liquid droplet is outputted.

Furthermore, whether or not liquid or a liquid droplet has been discharged may be determined by determining a matching state between a timing, at which the liquid or the liquid droplet is outputted according to the predetermined pattern, and a timing represented by the variation detected by said detection means.

Furthermore, whether or not liquid or a liquid droplet has been discharged may be determined by determining a matching state between a cycle, at which the liquid or the liquid droplet is outputted according to the predetermined pattern, and a cycle represented by the variation detected by said detection means.

Furthermore, whether or not liquid or a liquid droplet has been discharged may be determined by determining a matching state between a number of times of outputting the liquid or the liquid droplet according to the predetermined pattern and a number of times represented by the variation detected by said detection means.

Furthermore, the liquid or the liquid droplet is outputted according to a cycle which corresponds to a time constant of output variation detected by said detection means, and said measurement means measures the variation amount, caused by the liquid or the liquid droplet outputted, by integrating the values of said radiated wave detection means and the radiation detected by said detection means.

Furthermore, it is preferable to include heating means for heating the liquid or the liquid droplet prior to the detection of an infrared sensor, the radiated wave detection means includes the infrared sensor.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Before providing detailed description of embodiments, the feature of the embodiments is briefly described. According to the embodiments of the present invention, detection means for detecting a radiated wave (particularly infrared ray) radiated from liquid or a liquid droplet, e.g., ink, is provided near a path of the liquid or liquid droplet. By detecting a variation in the signal which is detected by the detection means, whether or not the liquid or liquid droplet has passed is detected without contacting the liquid or liquid droplet. Further, based on the amount of variation of the output value of the detection means, an existence/absence of liquid passed by or the amount of liquid is determined.

Among the radiated wave radiated from the liquid, an intensity of the radiated wave, particularly having an infrared wavelength, can easily be controlled by changing the temperature (heat quantity) of the liquid. In other words, by increasing the liquid temperature, the detection sensitivity can be improved. Thus, as the detection means, it is particularly effective to use an infrared ray sensor which detects a radiated wave having an infrared wavelength. However, a radiated wave of other wavelengths may be utilized.

An ink-jet printing apparatus according to the embodiment of the present invention employs a heater, serving as a heat generator, as a discharge-energy generator to provide heat energy to ink and generate bubbles in the ink. Therefore, when ink is discharged, because heat generated by the heater is transmitted to the ink, the discharged ink is heated. This is quite advantageous for the liquid detection method of the present embodiment. Furthermore, by providing ink heating means to control the ink temperature, the detection sensitivity can readily be controlled.

Note that although the following embodiments describe an ink-jet printing apparatus as an example, the present invention is not limited to this, but is applicable to, for instance, detecting movement or a residual amount of liquid fuel in an automobile or in equipment utilizing liquid fuel, or detecting liquid in a circulation system or chemical industrial plants.

Hereinafter, a preferred embodiment of the present invention is described with reference to accompanying drawings.

Figure 1:
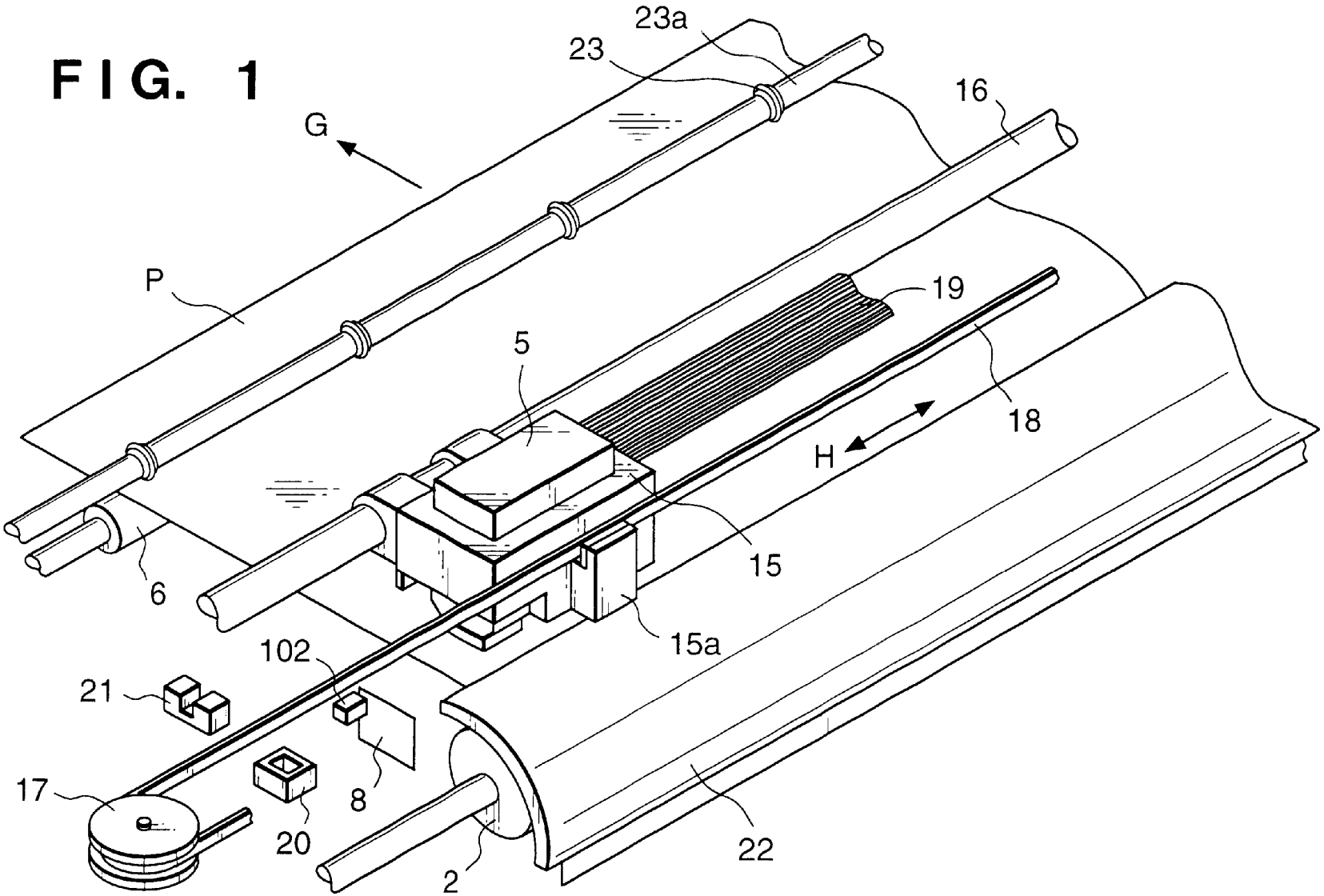
FIG. 1 is a perspective view showing a detailed construction of a printing unit of an ink-jet printing apparatus according to an embodiment of the present invention.

FIG. 1 is a perspective view showing a construction of a printing unit of an ink-jet printing apparatus according to the present embodiment.

Referring to FIG. 1, a printhead 5 is a cartridge-type printhead in which the entire printhead is exchangeable with a new printhead when ink is exhausted.

Hereinafter, a principle of ink discharge from the printhead 5 is described. The printhead 5 comprises: liquid discharge orifices generally having a very small size; an energy applying portion provided in a liquid path in each orifice or in a part of the liquid path; and energy generating means (hereinafter referred to as an energy generator or energy generating element) which generates liquid droplet forming energy to be applied to a liquid in the energy applying portion.

The energy generator may be of the type utilizing an electromechanical transducer such as a piezoelectric device or the like, or of the type which radiates an electromagnetic wave, e.g., laser, to be absorbed by a liquid (ink) so as to generate heat that causes a liquid droplet to discharge, or of the type utilizing an electrothermal transducer (e.g., 202 in FIG. 4) for heating a liquid and discharging a liquid droplet. Among them, particularly a printhead, which discharges liquid by utilizing heat energy, can have liquid discharge orifices (e.g., 201 in FIG. 4) at high density, wherein the liquid discharge orifices are provided for discharging liquid droplets to print an image. Therefore, with the use of such printhead, printing can be performed at high resolution.

Furthermore, a printhead employing an electrothermal transducer as an energy generator can readily be downsized, and can sufficiently take advantage of the IC techniques or micromachining techniques which demonstrate considerable development and improved reliability of techniques in the latest semiconductor field. Furthermore, since the printhead can easily be formed into an elongated shape or a sheet-like shape (having two-dimensional orientation), a plurality of nozzles can be incorporated at high density, and mass production is possible, thus the manufacturing cost can be reduced.

A printhead, employing an electrothermal transducer as an energy generator and manufactured in a semiconductor manufacturing process, generally comprises liquid paths corresponding to respective ink discharge orifices. Heat energy is applied to the liquid in each of the liquid paths, and liquid is discharged from respective ink discharge orifices, in the discharging droplets form. A common liquid chamber, connected to each of the liquid paths, supplies liquid to each liquid path.

Referring back to FIG. 1, the construction of the printing unit is described.

Figure 2:
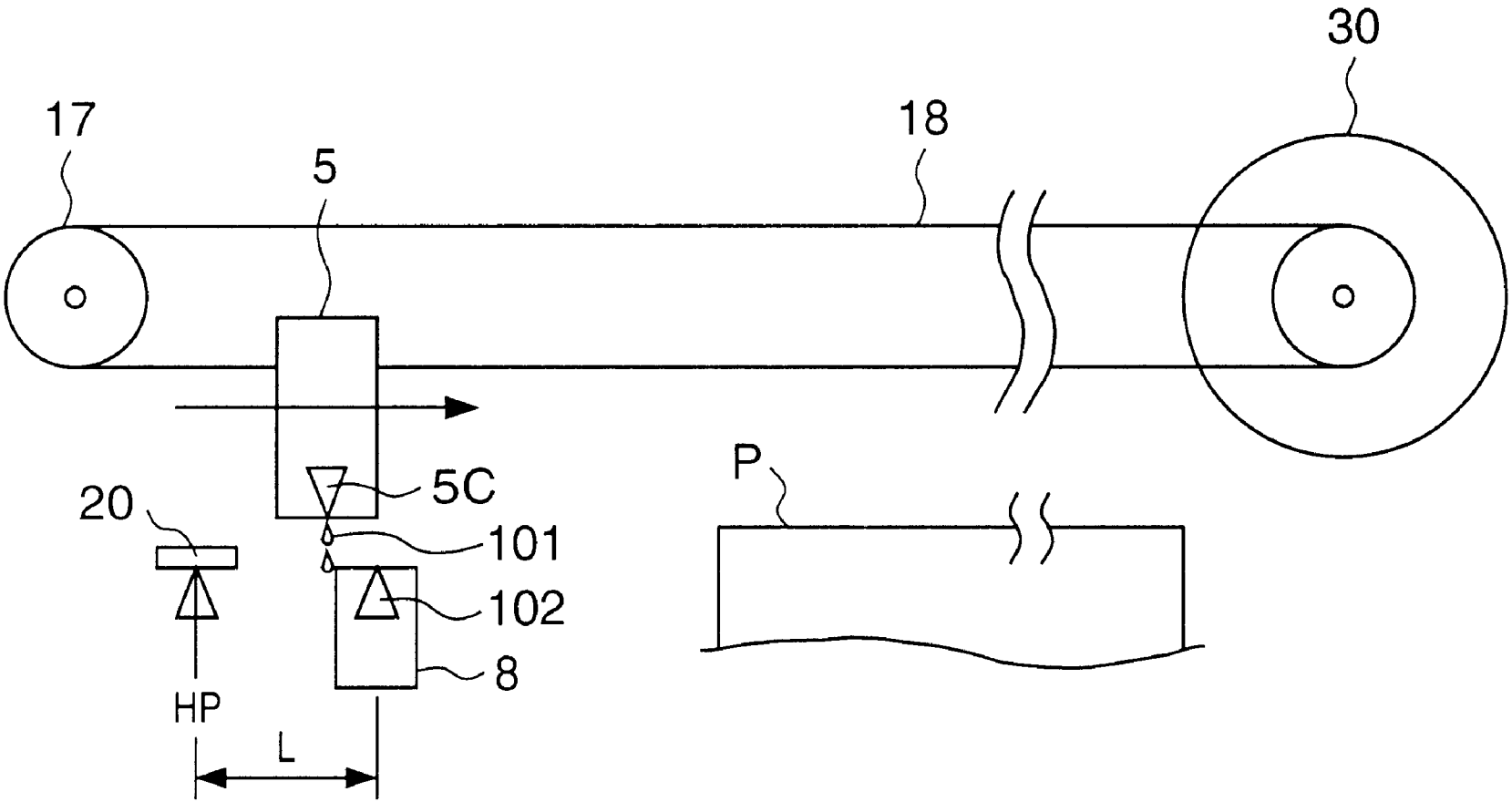
FIG. 2 is a conceptual view showing a structure on the periphery of an ink detection unit of the printing unit shown in FIG. 1.

In FIG. 1, a carriage 15 reciprocally moves in the direction (main-scanning direction indicated by the arrow H) which is substantially perpendicular to the print paper P conveyance direction (sub-scanning direction indicated by the arrow G), while holding the printhead 5 with high precision. The carriage 15 is slidable along a guide 16 and held by the guide 16 and notch 15*a* which fixes the carriage 15 and timing belt 18. The reciprocal movement of the carriage 15 is realized by a pulley 17 and the timing belt 18 driven by a carriage motor 30 (FIG. 2). Print signals and electric power provided to the printhead 5 are supplied from an electric circuit of the apparatus main body through a flexible cable 19. The printhead 5 and flexible cable 19 are connected at respective contact points. At the home position of the carriage 15 in the printing unit, a cap 20 is provided to serve as ink receiving means. The cap 20 moves up and down as needed. When the cap 20 is moved up, the cap 20 covers the nozzle portion of the printhead 5 to prevent ink evaporation or attachment of dust and other contaminants.

To position the printhead 5 and cap 20 relatively opposite from each other, the ink-jet printing apparatus employs a carriage home sensor 21 provided on the apparatus main body and a light shielding plate 15*b* provided on the carriage 15. For the carriage home sensor 21, a transmission photo-interrupter is employed. The transmission photo-interrupter detects that the printhead 5 and cap 20 are positioned relatively opposite from each other by utilizing the fact that, when the carriage 15 moves to the home position, a part of the light received by the carriage home sensor 21 is shielded by the light shielding plate 15*b*.

The print paper P is fed from the lower right to the upper left of the drawing sheet of FIG. 1, transferred in the horizontal direction by a feeding roller 2 and paper guide 22, and conveyed in the direction of arrow G (sub-scanning direction). The feeding roller 2 and discharge roller 6 are respectively driven by rotation of a conveyance motor 31 (FIG. 5), and convey the print paper P with precision in the sub-scanning direction in synchronization with reciprocal movement of the carriage 15 when necessary. In the sub-scanning direction, spurs 23 are provided. The spurs 23 are formed with water-repellent material, and come in contact with the paper P only at the spur's edged circumferential portion. The spurs 23 are provided at plural points opposite from the discharge roller 6, while being separated from each other by bearing members 23*a* by a predetermined distance in the main-scanning direction. By this configuration, the spurs 23 can guide and convey the print paper P without deteriorating an image yet to be fixed on the print paper immediately after printing is performed.

An ink detection unit 8 comprises an infrared ray sensor 102 for detecting an infrared ray radiated from an ink droplet 101 (because ink is heated) which will be described later with reference to FIG. 3. As shown in FIG. 2, the ink detection unit 8 is arranged at a position opposite from the nozzle array 5*c* of the printhead 5 between the cap 20 and the edge of the print paper P. The infrared ray sensor 102 detects an infrared ray radiated by the ink droplet 101 discharged from a plurality of nozzles of the printhead 5.

First Embodiment

Figure 3:
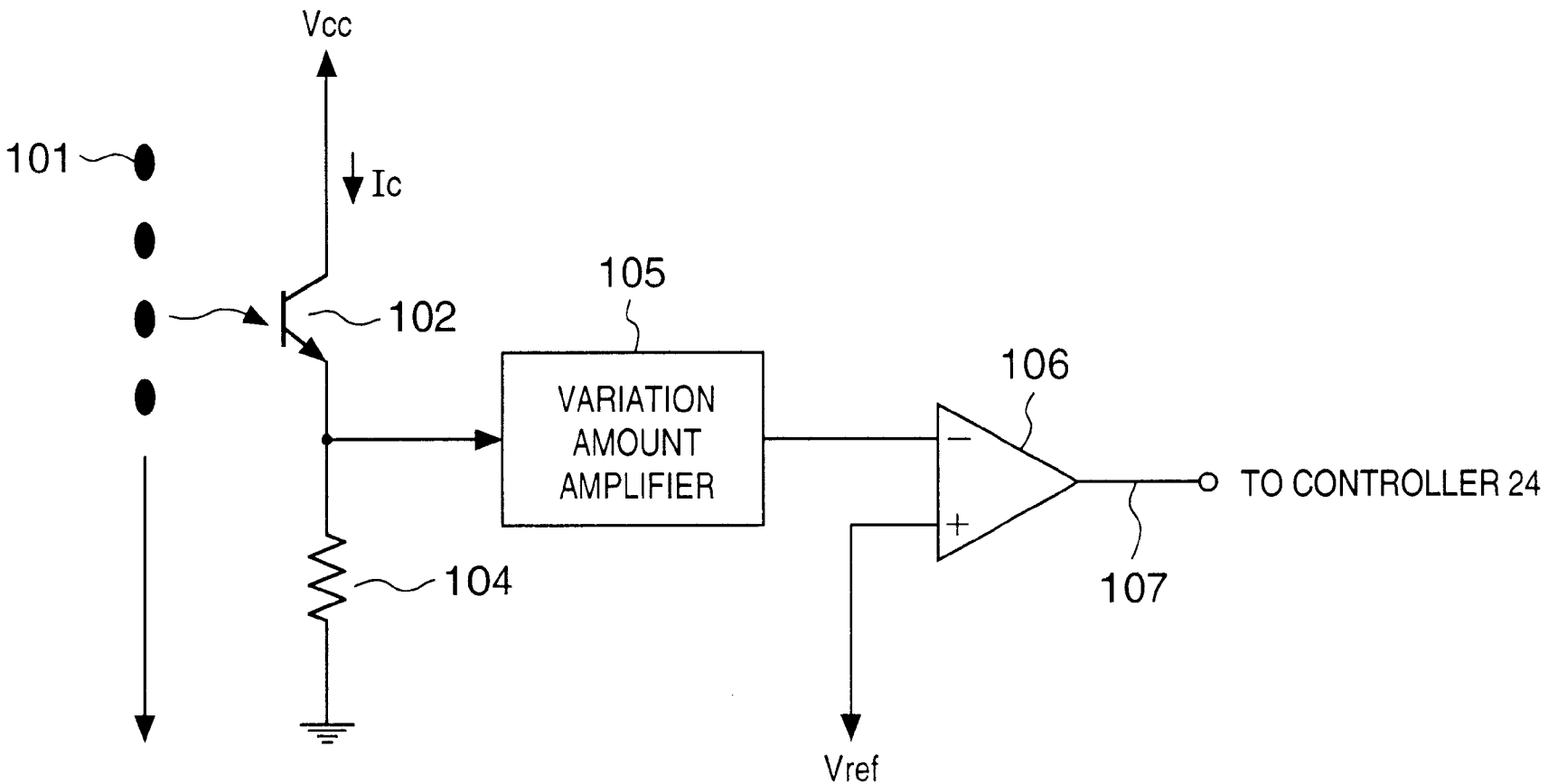
FIG. 3 is a circuit diagram showing a construction of the ink detection unit according to the embodiment of the present invention.

FIG. 3 is a circuit diagram showing a construction of the ink detection unit 8 according to a first embodiment of the present invention.

In FIG. 3, reference numeral 102 denotes an infrared ray sensor; 104, a resistance; 105, a variation amount amplifier; and 106, a comparator. The variation amount amplifier 105 detects a differential voltage based on an output current of the infrared ray sensor 102, and amplifies the differential voltage and outputs it.

In the above construction, when an ink droplet 101, discharged from a nozzle of the printhead 5, passes near the infrared ray sensor 102, the infrared ray sensor 102 detects an infrared ray radiated from the ink droplet 101 and generates a current corresponding to the detected amount of infrared ray. As a result, a potential determined by the current and the resistance 104 is inputted to the variation amount amplifier 105. Then, the variation amount amplifier 105 amplifies the differential voltage (potential). The comparator 106 compares the potential supplied from the variation amount amplifier 105 with a reference potential Vref. If the output potential of the variation amplifier 105 is higher than Vref, the level of a signal 107 becomes low. In response, a controller 24 (FIG. 5) measures the time period (pulse width) during which the signal 107 is in the low level. If the time period of low level is longer than a predetermined time (the amount of ink discharged is more than a predetermined amount), it is determined that ink discharge has been properly performed.

Figure 4:
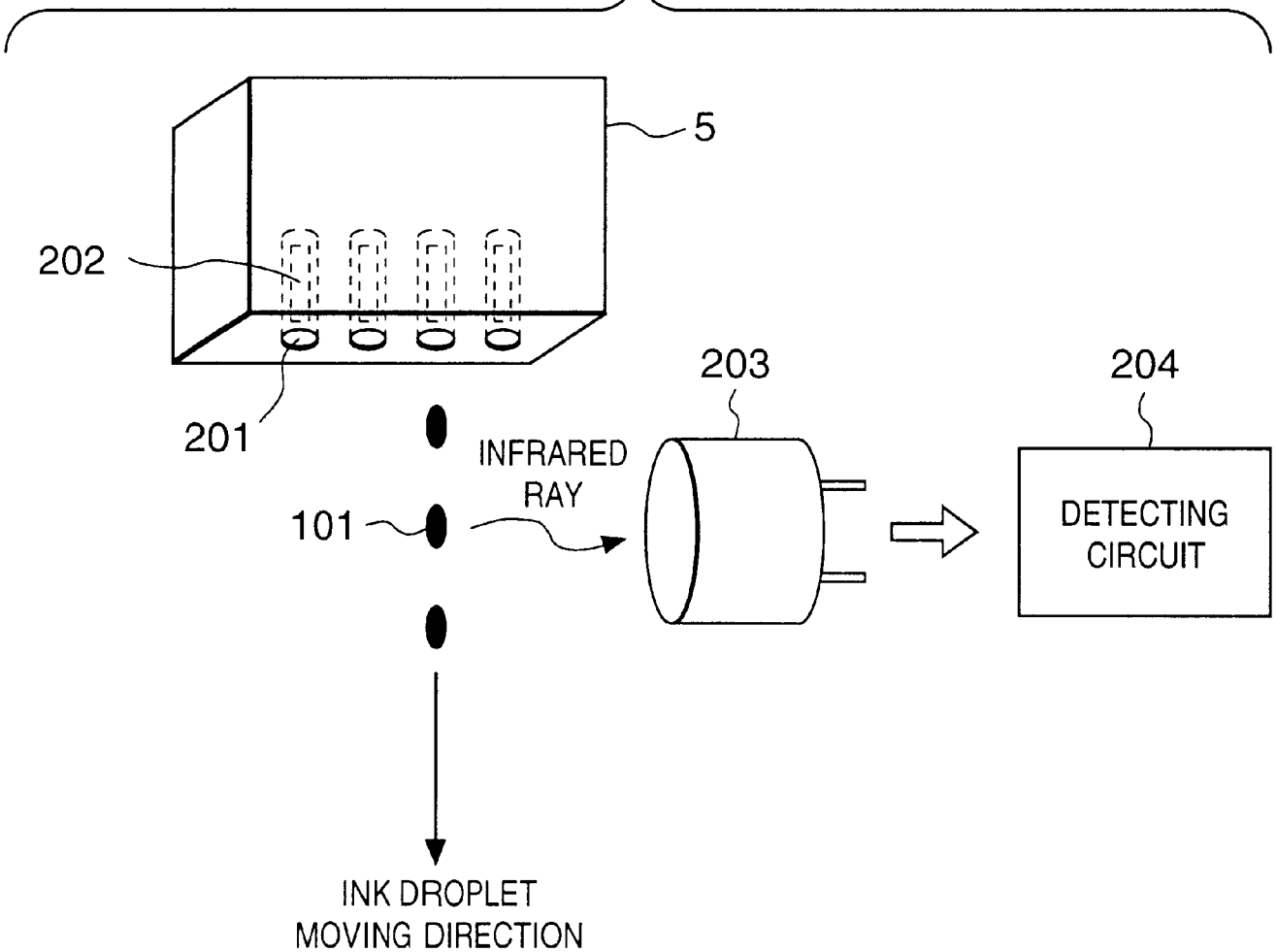
FIG. 4 is a conceptual view explaining detection of an ink droplet according to the first embodiment of the present invention.

FIG. 4 is a conceptual view explaining detection of an ink droplet according to the first embodiment.

Referring to FIG. 4, nozzles of the printhead 5 are filled with ink. Reference numeral 201 denotes nozzles for discharging ink. The nozzles 201 respectively comprise heaters 202 for heating and discharging ink. When an electric current is applied to the heaters 202, ink in the nozzles is heated, causing bubble generation in the ink in the nozzles, and an ink droplet is discharged from the nozzle orifices by the pressure of the bubbles. Reference numeral 101 represents the ink droplet discharged in this manner. Near the path of the ink droplet 101, a radiated-wave detector 203 (e.g., aforementioned infrared ray sensor 102) is provided without coming into contact with the ink droplet 101, and performs detection of whether or not an ink droplet has passed, or detection of the amount of ink droplet passed by, without contacting the ink droplet 101. If the detection sensitivity of the radiated-wave detector 203 has directivity, naturally, the portion having a high sensitivity is directed to the path of the ink droplet 101.

The ink droplet 101, immediately after being discharged from the nozzle 201, has been heated by the heater 202 before the discharge. Therefore, among the radiated wave radiated from the ink droplet 101, a radiated wave having the infrared bandwidth has the highest intensity. Accordingly, the first embodiment employs the infrared ray sensor 102, which can detect a radiated wave having the infrared bandwidth, as the radiated-wave detector 203. As a matter of course, the heaters 202 may be used for, instead of ink discharge, intentionally increasing temperature of the ink. As a typical infrared ray sensor 102, a pyroelectric infrared ray sensor, utilizing a pyroelectric element which generates potential changes by waves of an infrared wavelength, is known. In a case of using the pyroelectric element, the voltage outputted by the infrared ray sensor 102 may be directly inputted to the comparator 106.

In the above-described manner, an output of the radiated-wave detector 203 (infrared ray sensor 102) varies each time the discharged ink droplet 101 passes near the detector 203. Therefore, by detecting the variation (differential potential) of the output with a detecting circuit 204, whether or not the ink droplet 101 has passed can be detected. Furthermore, in a case where the ink droplet 101 is discharged at a constant temperature, the amount of variation in the output of the radiated-wave detector 203 (infrared ray sensor 102) is detected by the detecting circuit 204, and if necessary, the output signals of the detecting circuit 204 are integrated to detect the amount of ink droplet 101 which has passed by.

In a case where the ink-jet printing apparatus according to the first embodiment detects a radiated wave having the infrared bandwidth radiated from liquid (ink), the detection sensitivity can be further improved by raising the temperature of the liquid (ink) in advance. For this reason, it is preferable if the embodiment is provided with heating means for heating the liquid in advance. According to the first embodiment, since the heaters 202 of the ink-jet printing apparatus sufficiently serve this function, the construction of the present embodiment is quite suitable.

Note that as means for raising the temperature of ink, another heater may be provided in the printhead besides the heater serving as an electrothermal transducer for discharging ink, or another heater may be provided inside the ink tank which supplies ink. In this case, the ink temperature may be raised to an appropriate temperature as long as it is detectable by the detection means. It is preferable that the heaters be controlled within the range that does not improperly cause viscosity change or coagulation of ink due to heating of ink and ink evaporation.

Figure 5:
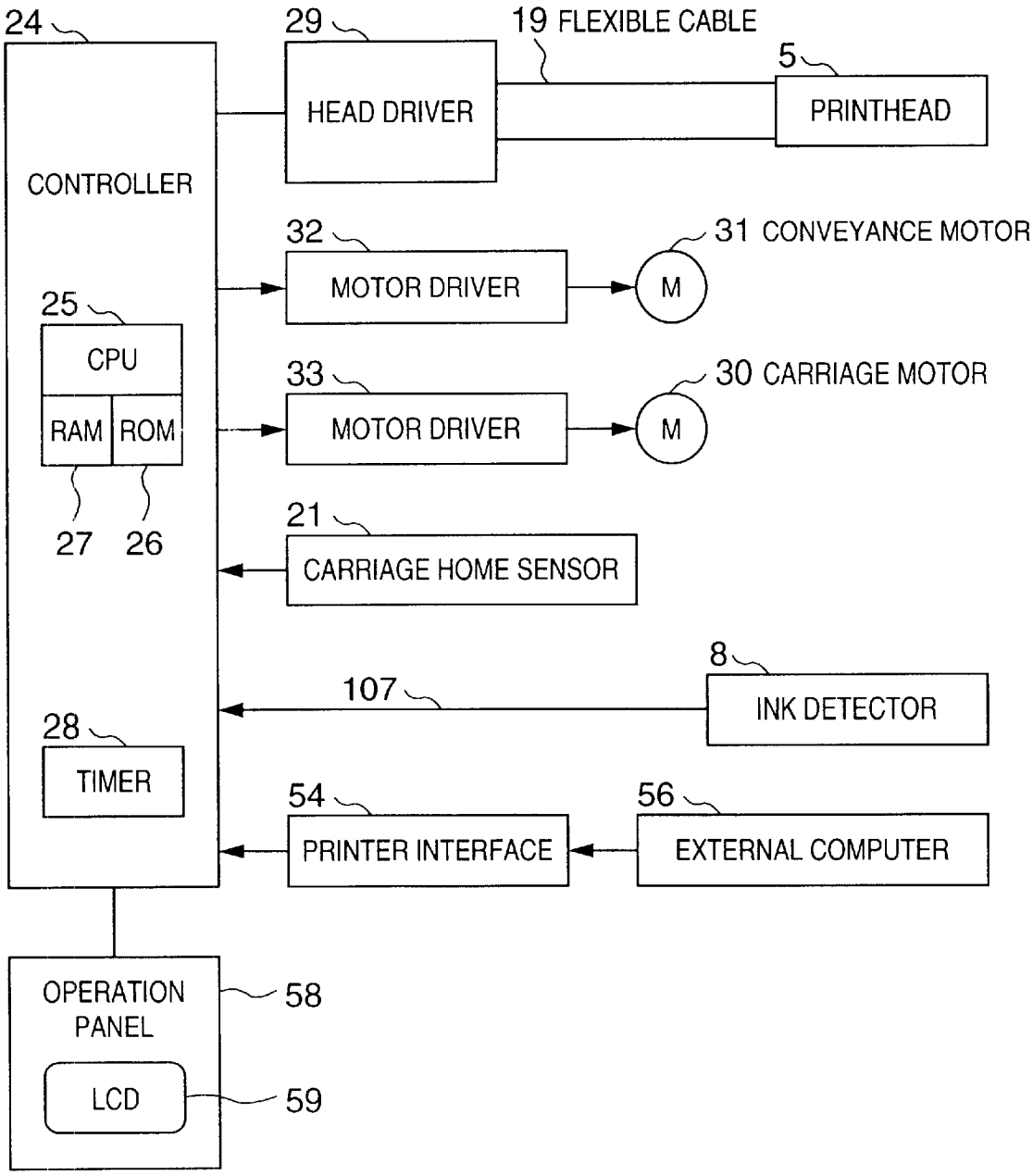
FIG. 5 is a block diagram showing a functional configuration of an ink-jet printing apparatus according to the first embodiment.

FIG. 5 is a block diagram showing a functional configuration of an ink-jet printing apparatus according to the first embodiment.

In FIG. 5, reference numeral 24 denotes the controller for controlling the entire apparatus. The controller 24 includes: a CPU 25; ROM 26 for storing control programs to be executed by the CPU 25 and various data; RAM 27 used as a work area of the CPU 25 for executing various processing or used for temporarily storing various data; and a timer 28 for timing according to the control of the CPU 25.

As shown in FIG. 5, the printhead 5 is connected to a head driver 29 with the flexible cable 19. From the head driver 29, control signals, image signals or the like are supplied to the printhead 5 based on an instruction from the controller 24. An output signal of the ink detector 8 is inputted to the controller 24, and the CPU 25 can determine existence/absence of ink or the amount of ink discharged based on the pulse width or the number of pulses in the signal. A carriage motor 30 rotates in accordance with a phase excitation signal outputted by a motor driver 32 based on the signal from the controller 24. The controller 24 controls rotation of the carriage motor 30 through a motor driver 33, and controls rotation of the conveyance motor 31 through the motor driver 32.

The controller 24 is also connected to a printer interface 54 which receives a print command or print data from an external computer (host unit) 56. The controller 24 is also connected to an operation panel 58 which allows an operator to perform various operation and input instructions. The operation panel 58 includes a display unit (LCD) 59 for displaying various messages addressed to an operator.

Figure 6:
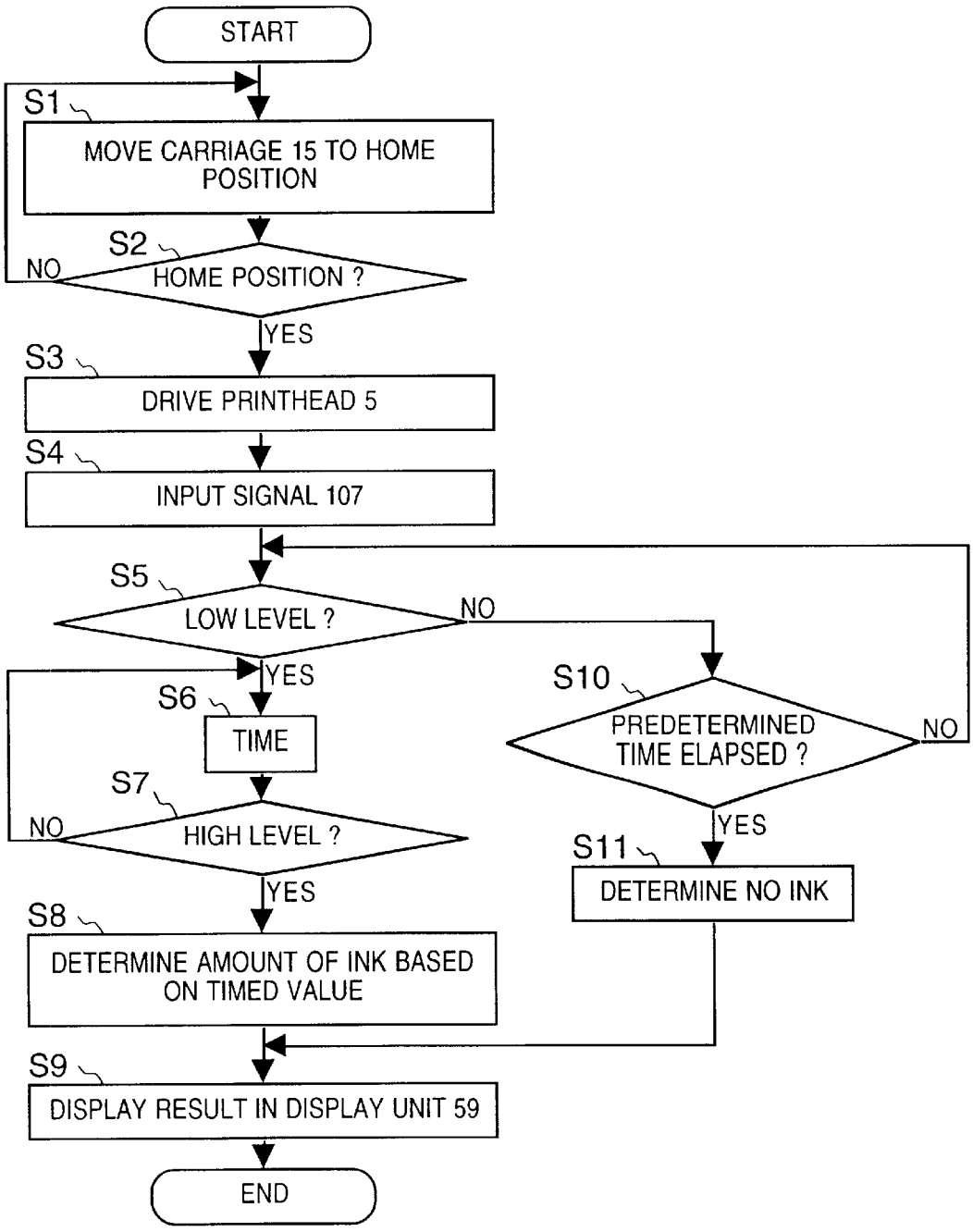
FIG. 6 is a flowchart showing a processing performed in the ink-jet printing apparatus according to the first embodiment.

FIG. 6 is a flowchart showing a detection processing of whether or not ink has been discharged and the amount of ink discharged in the ink-jet printing apparatus according to the first embodiment of the present invention. The control program which executes this processing is stored in the ROM 26 of the controller 24, and executed under the control of the CPU 25.

In step S1, the carriage motor 30 is rotated to move the carriage 15 to the home position. When the carriage 15 reaches the home position in step S2, then in step S3, print data whose values are 1 for all dots is outputted to the printhead 5 and the printhead 5 is driven by the print data, thereby discharging ink from all nozzles of the printhead 5. In step S4, the signal 107 is inputted from the ink detector 8, and it is determined in step S5 whether or not the signal 107 is in the low level. If the signal 107 is in the low level, the control proceeds to step S6 where an address content is incremented by 1 by utilizing, e.g., an address of the RAM 27 as a counter. This processing is repeated until the level of the signal 107 becomes high in step S7. Note that the aforementioned timer 28 may be used for timing the period during which the signal 107 is in the low level.

After the time period during which the signal level is low is timed, the control proceeds to step S8. Then, the amount of ink discharged is determined based on the timed value (low-level pulse width) stored in the address. In step S9, the result of determination, e.g., whether or not ink has been discharged or the amount of ink discharged, is displayed in the display unit 59, and the process ends.

Meanwhile, in step S5, if the level of the signal 107 is not low, the control proceeds to step S10 where it is determined whether or not a predetermined time has elapsed from the start of driving the printhead 5 (step S3). If not, the control returns to step S5 and the level of the signal 107 is checked again. If the level of the signal 107 does not become low after the lapse of the predetermined time, the control proceeds to step S11. Since ink is not discharged, determination is made in step S11 that the ink tank contains no ink (or nozzle is defective), then in step S9, this result is displayed.

Note in the above-described first embodiment, although ink is discharged by supplying the printhead 5 with the print data whose values are 1 for all dots, the present invention is not limited to this. In a case where a printhead has a large number of nozzles, for instance, each nozzle may be driven for detecting the amount of ink discharged by each of the nozzles.

As has been set forth above, according to the first embodiment of the present invention, whether or not ink has been discharged or the amount of ink discharged can be detected with high precision.

Second Embodiment

Next, the second embodiment of the present invention is described. According to the second embodiment, ink is discharged by driving the printhead at a predetermined drive timing, and in synchronization with the drive timing, an ink droplet is detected. By this configuration, detection precision of the ink droplet is further improved. Note that the construction of an ink-jet printing apparatus according to the second embodiment is the same as that of the first embodiment. Therefore, detailed description thereof is omitted.

Figure 7:
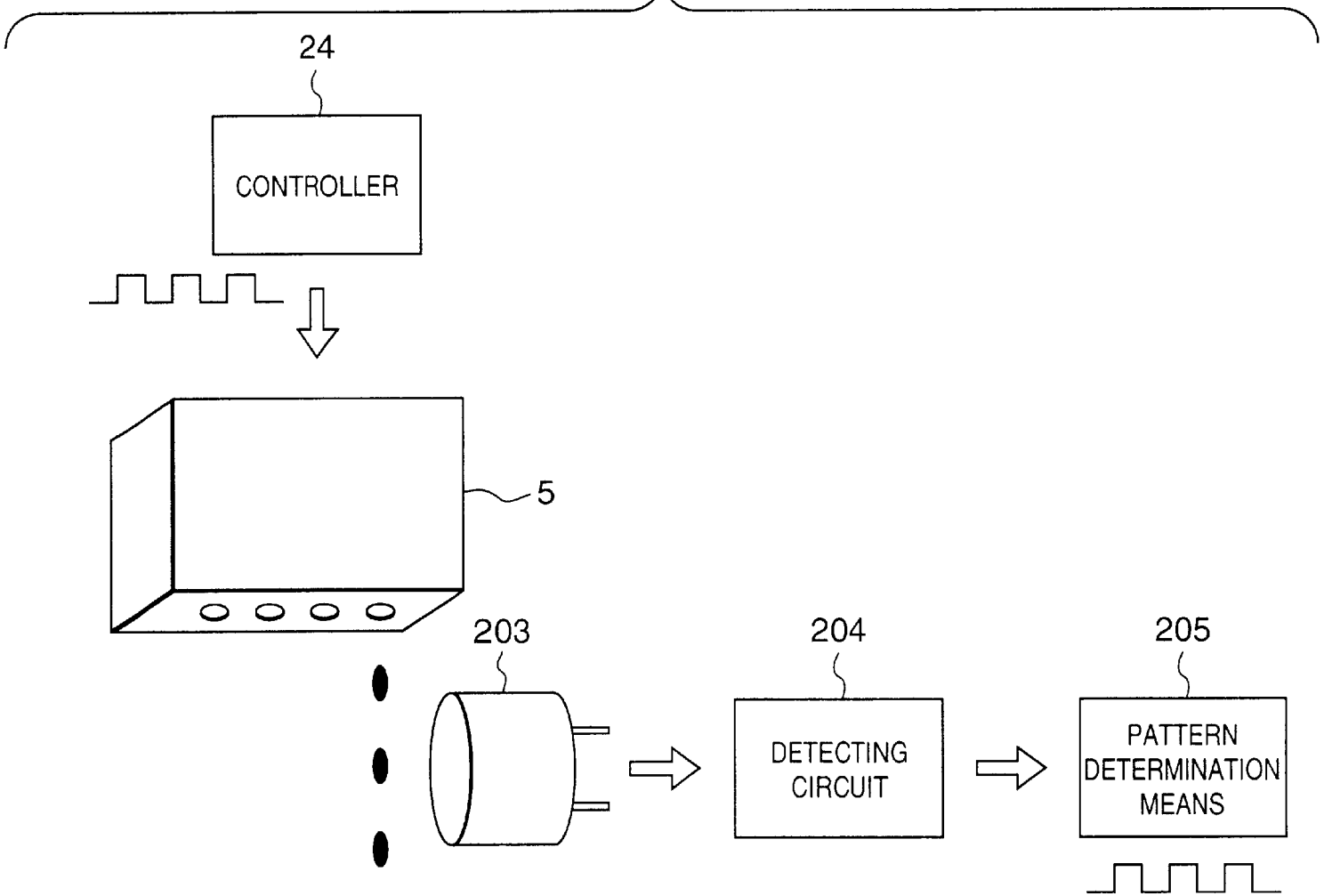
FIG. 7 is a conceptual view describing detection of an ink droplet according to the second embodiment of the present invention.

FIG. 7 is a conceptual view describing a construction of the second embodiment.

The controller 24 drives the printhead 5 at a predetermined drive timing to cause liquid (ink) discharge from a nozzle. A pattern determination means 205 determines whether or not an output timing of an ink droplet, discharged by the nozzle of the printhead 5 driven by the controller 24, matches an output timing of a signal which is detected by the radiated-wave detector 203 and outputted by the detecting circuit 204. For instance, the number of times of ink discharged within a predetermined drive timing is determined. Only if the number of times of ink discharge matches the number of times of ink droplet detection, determination is made that ink has been normally discharged from the nozzle of interest.

Alternatively, an ink discharge cycle within a predetermined drive timing may be determined. Only if the cycle of ink discharge matches the cycle of ink droplet detection, determination is made that ink has been normally discharged from the nozzle of interest.

As described above, based on the number of times or the cycle of detection of a discharged ink droplet which has been detected based on the output signal of the detecting circuit 204, whether or not a drive timing pattern (time, timing, cycle, number of times or the like) for ink discharge matches an ink droplet detection timing pattern is determined. By virtue of this, the signal-to-noise ratio can be improved in detecting a micro ink droplet (liquid droplet). Accordingly, precision of ink droplet detection can be improved, and erroneous detection due to a disturbance at the time of detection operation can be prevented.

Furthermore, there is a method effective for detecting a micro liquid droplet. Liquid (ink) is discharged continuously under the control of the controller 24 in a cycle corresponding to a time constant of output variation of the radiated-wave detector 203 (infrared ray sensor 102) and detecting circuit 204, and the output values of the radiated-wave detector 203 and detecting circuit 204 are integrated to increase the signal-to-noise ratio of the output. Accordingly, the liquid detection sensitivity can be improved.

Note that in the foregoing embodiments, description has been provided on detecting an ink droplet in an ink-jet printing apparatus. However, as another example of application, injected fuel may be detected in a fuel injection unit of an engine.

Figure 8:
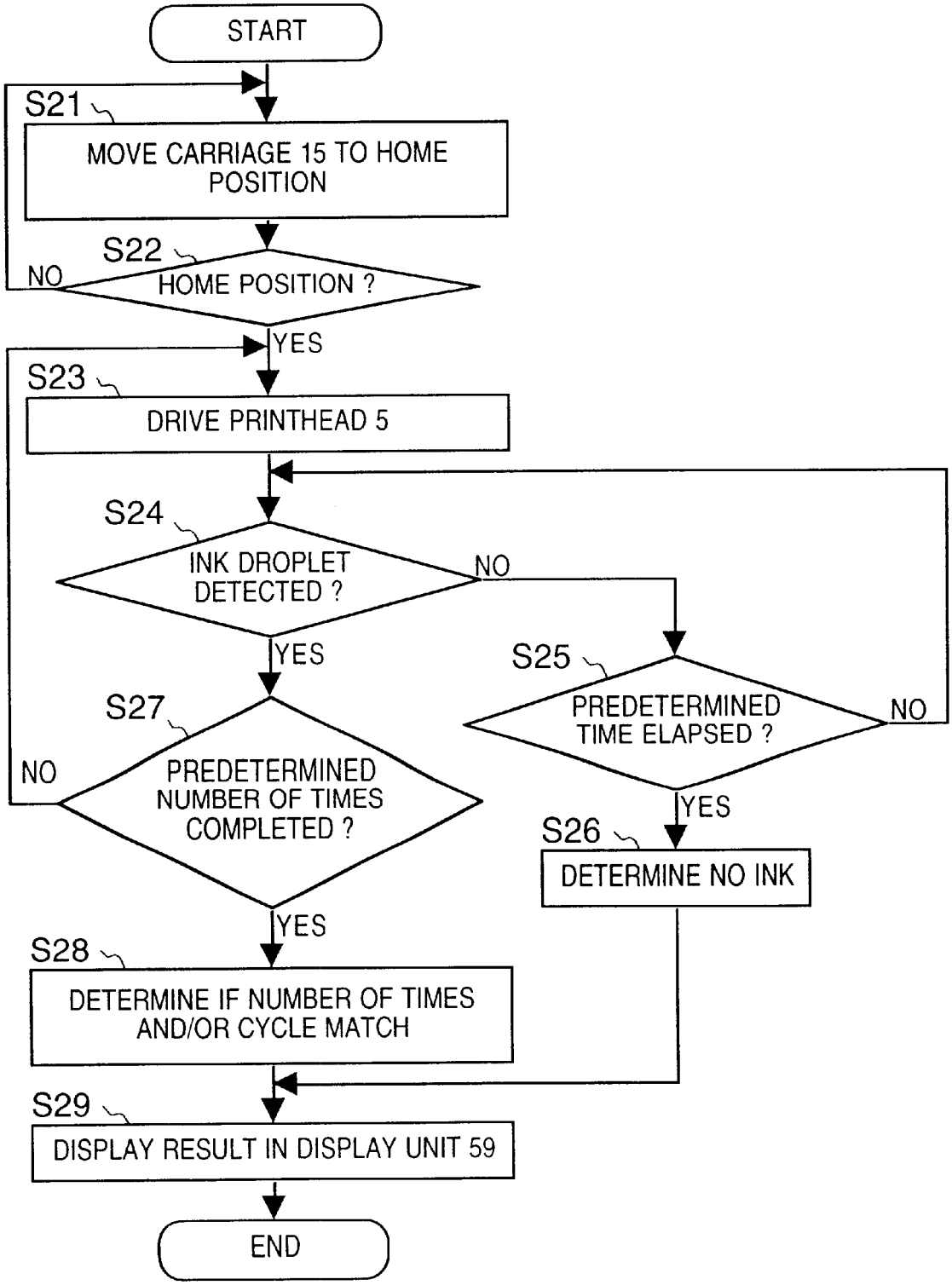
FIG. 8 is a flowchart showing a processing performed in the ink-jet printing apparatus according to the second embodiment.

FIG. 8 is a flowchart showing a detection processing of an ink droplet in the ink-jet printing apparatus according to the second embodiment. The control program which executes this processing is stored in the ROM 26 of the controller 24, and executed under the control of the CPU 25.

In step S21, the carriage motor 30 is rotated to move the carriage 15 to the home position. When the carriage 15 reaches the home position in step S22, then in step S23, the printhead 5 is driven according to a predetermined pattern (data) to discharge ink from the nozzle of the printhead 5. In step S24, the signal 107 is inputted from the ink detector 8, and it is determined whether or not an ink droplet 101 is detected by the infrared ray sensor 102. If not, the control proceeds to step S25 where it is determined whether or not a predetermined time has elapsed from the start of driving the printhead 5 (step S23). If not, the control returns to step S24 and the level of the signal 107 is checked again. If the level of the signal 107 does not become low after the lapse of the predetermined time, the control proceeds to step S26. Since ink is not discharged, determination is made in step S26 that the ink tank contains no ink (or nozzle is defective), then in step S29, this result is displayed.

Although the determination processing of whether or not a predetermined time has elapsed is performed in step S25, in a case where no ink droplet is detected in step S24, the control may immediately proceed from step S24 to step S26.

Meanwhile, if an ink droplet is detected in step S24, the control proceeds to step S27 where the number of times of detection and/or cycle of detection are stored in the RAM 27. Then, it is determined in step S27 whether or not ink discharge operation has been performed a predetermined number of times. If not, the control returns to step S23, and the above-described processing is executed. Upon performing ink discharge operation for a predetermined number of times and performing ink detection, the control proceeds from step S27 to step S28. Then, the number of times and/or the cycle of ink discharge operation and ink droplet detection are obtained, and it is determined whether or not these values match. If a complete match is found, determination is made that ink droplet detection has been properly performed. If the number of times and/or the cycle do not match, determination is made that the detected ink droplet is not caused by an ink discharge operation, or that ink has not been discharged despite the ink discharge operation. The determination result is displayed on the display unit 59 of the operation panel 58, or transferred to the host computer or the like via an interface.

As has been described above, the second embodiment has an effect in that whether or not ink has been discharged is detected with high precision. Furthermore, based on the determination of whether or not a pattern corresponding to each nozzle matches a pattern of a detection output, discharge failure for each nozzle can be detected.

Third Embodiment

Next, the third embodiment of the present invention is described. Since the construction of an ink-jet printing apparatus according to the third embodiment is the same as that of the foregoing embodiments, detailed description thereof is omitted.

According to the third embodiment, whether or not an ink droplet has been discharged by a nozzle of the printhead 5 is detected by the infrared ray sensor 102, and in a case where an ink droplet is not detected, it is determined whether or not to perform recovery processing of the printhead 5 for automatically performing recovery processing.

Figure 9:
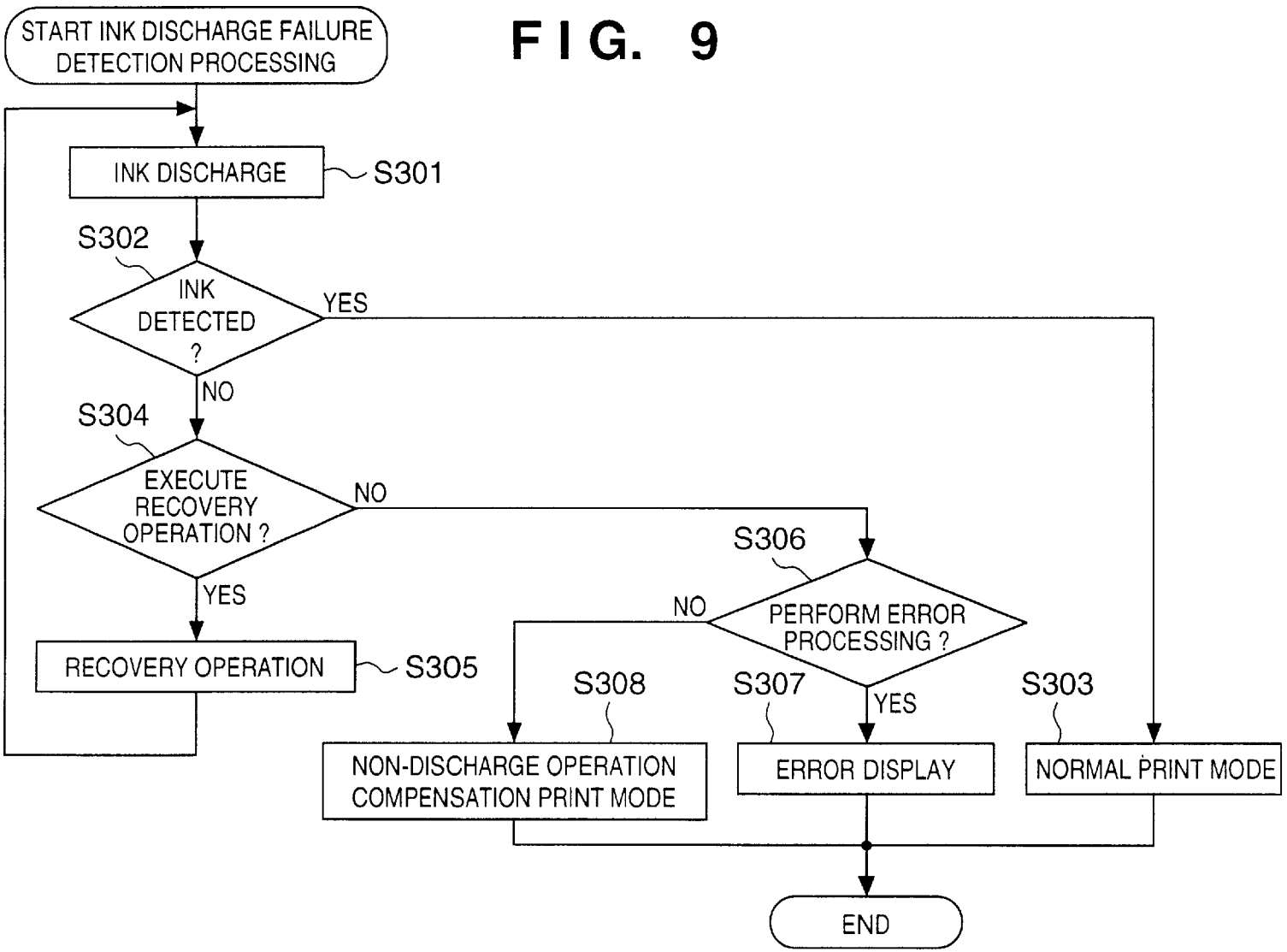
FIG. 9 is a flowchart showing a processing performed in an ink-jet printing apparatus according to the third embodiment of the present invention.

This processing is described with reference to the flowchart in FIG. 9.

The ink-jet printing apparatus according to the third embodiment comprises discharge failure detection means (corresponding to the infrared ray sensor 102) for detecting whether or not an ink droplet has passed when ink discharge operation is performed (steps S301 and S302). By this, it is possible to determine whether or not ink is normally discharged. If ink discharge failure is not detected in step S302, the control proceeds to step S303 for performing printing in a normal print mode.

Meanwhile, if ink discharge failure is detected in step S302, the control proceeds to step S304 for determining whether or not to perform recovery operation to recover from the discharge failure. Herein, for instance, based on the number of times of recovery processing performed so far, determination of whether or not to further perform recovery processing is made. To perform recovery operation, the control proceeds to step S305. Then, the control returns to step S301 for detecting ink discharge failure. Note that the determination in step S304 may be made based upon, for instance, a key input operation on the operation panel 58.

If recovery operation is not to be performed in step S304, the control proceeds to step S306 where it is determined whether or not to perform error processing of ink discharge failure. To perform error display processing, the control proceeds to step S307 for displaying an error message on the display unit 59 of the operation panel 58 to inform the user. If error display processing is not to be performed in step S306, the control proceeds to step S308. In step S308, a non-discharge compensation print mode may be executed to print the non-printed area with another nozzle instead of the nozzle from which ink is not discharged.

According to the non-discharge compensation print mode, in a case where the printhead 5 has a plurality of nozzles, whether or not ink is discharged is determined for each nozzle. If there is a nozzle not discharging ink despite driving of the printhead, another normally operating nozzle is used in place of that nozzle, and image printing is performed with the normal nozzles only.

Note that detection of an ink discharging state for each nozzle can be realized by the construction described in the foregoing embodiments.

By performing the above-described operation, not only it can be accurately determined whether or not each nozzle of the printhead is actually discharging ink, but also recovery processing can be performed only when necessary. By virtue of this, unnecessary ink consumption can be prevented, and the time required for recovery processing can be reduced.

Furthermore, by performing printing in the non-discharge compensation mode, an image can be printed without deteriorating the print quality even if the printhead includes a nozzle (nozzles) having an ink discharge failure.

Ink-jet printing apparatuses which can effectively apply the above-described ink discharge failure detection processing are: printers, facsimiles, color filter manufacturing apparatuses, printing apparatuses for printing images on a cloth and so forth, all employing ink-jet printing method.

Fourth Embodiment

Next, the fourth embodiment of the present invention is described. According to the fourth embodiment, ink movement is detected inside a tube (substantially transparent) which supplies ink from an ink tank to a printhead, thereby detecting the residual amount of ink in the ink tank.

Figure 10:
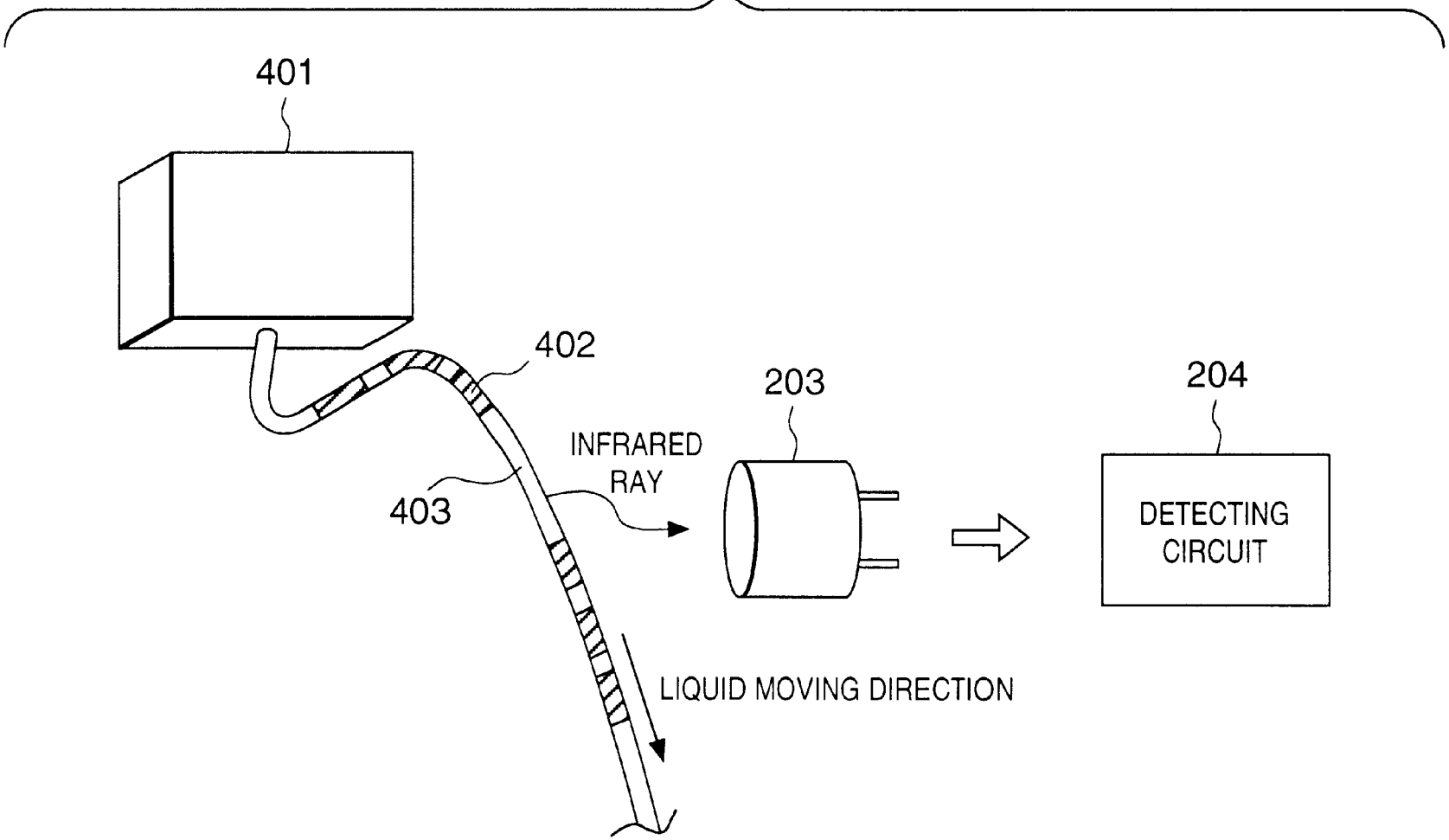
FIG. 10 is a conceptual view describing detection of the amount of residual ink according to the fourth embodiment of the present invention.

FIG. 10 is a conceptual view showing a construction of the fourth embodiment. In FIG. 10, reference numeral 401 denotes a tank containing liquid (ink). A tube 402 is extended from the tank 401 to supply the liquid from the tank. Reference numeral 403 denotes liquid moving inside the tube 402. Along the path of the liquid moving inside the tube 402, the aforementioned radiated-wave detector 203 is provided at a position not contacting the liquid (tube), enabling detection of whether or not liquid has passed or the amount of liquid passed in the tube 402, without contacting the liquid.

In this construction, the radiated-wave detector 203 detects an infrared ray of a radiated wave which is radiated from the liquid passing through the tube 402. The aforementioned infrared ray sensor 102 is employed as the radiated-wave detector 203. The principle of liquid detection is the same as that described in the foregoing embodiments. In other words, besides the fact that the detecting subject is now the liquid 403 in the tube 402 instead of the ink droplet 101, liquid detection can be performed in the same manner as that described in the foregoing embodiments.

Note as mentioned in the foregoing embodiments, a heater for heating ink may be provided to improve detection precision. The heater is arranged at a position closer to the tank 401 than the liquid detection position, for achieving high precision detection.

The construction of the fourth embodiment is applicable to an ink supply system of a printhead in an ink-jet printing apparatus, a fuel supply system of an engine or various oil supply systems, a circulation system, a raw material supply system in chemical industrial plants or the like. Particularly with respect to the liquid (e.g., radiator coolant) circulating an engine or a system incorporating an engine, the liquid temperature can easily be increased by making use of the heat generated by the engine. Therefore, the liquid detection apparatus according to the fourth embodiment which detects an infrared ray is extremely effective.

Each of the embodiments described above comprises means (e.g., an electrothermal transducer, laser beam generator, and the like) for generating heat energy as energy utilized upon execution of ink discharge, and adopts the method which causes a change in state of ink by the heat energy, among the ink-jet printing method.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and causes a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse-form driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Application Laid-Open No. 59-123670 which discloses the arrangement using a slot common to a plurality of electrothermal transducers as a discharge portion of the electrothermal transducers, or Japanese Patent Application Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a main color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, ink which is solid in a non-use state and liquefies upon heating, e.g., ink which liquefies upon application of heat energy according to a printing signal and is discharged in a liquid state, ink which begins to solidify when it reaches a printing medium, or the like, is applicable to the present invention. In this case, ink may be situated opposite to electrothermal transducers while being held in a liquid or solid state in recess portions of a porous sheet or through holes, as described in Japanese Patent Application Laid-Open No. 54-56847 or 60-71260. In the present invention, the above-mentioned film boiling system is most effective for the above-mentioned inks.

Note that although the foregoing embodiments describe as an example an ink-jet printing apparatus which employs a heater serving as an electrothermal transducer to generate ink discharging energy, the present invention is also applicable to an ink-jet printing apparatus which discharges ink by utilizing a device generating a mechanical pressure, e.g., piezoelectric device. When utilizing the method of discharging ink by such a piezoelectric device, since the temperature difference between ink and environment is low, a heater is provided to increase the ink temperature for the purpose of detecting ink discharge failure. By this, an occurrence of ink discharge failure can be detected with high precision.

In addition, the printing apparatus of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program. In this case, the program codes read from the storage medium realize the functions according to the embodiments, and the storage medium storing the program codes constitutes the invention. Furthermore, besides aforesaid functions according to the above embodiments are realized by executing the program codes which are read by a computer, the present invention includes a case where an OS (operating system) or the like working on the computer performs a part or the entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or the entire process in accordance with designations of the program codes and realizes functions of the above embodiments.

Note that although the construction of each of the above-described embodiments is described independently, alone or a combination of the above-described constructions can constitute the present invention.

Furthermore, according to the above-described embodiments, when a printhead is driven for discharging ink, data is outputted such that ink is discharged by all nozzles of the printhead. However, for instance, in a case where ink discharge/no-discharge is detected for each nozzle, it is preferable that data be outputted such that ink is discharged only from a particular nozzle. By this, ink discharge failure can be detected for each nozzle.

As has been set forth above, according to the foregoing embodiments, it is possible to detect whether or not liquid or a liquid droplet has passed or the amount of liquid passed without contacting the liquid or liquid droplet. Particularly, detection performance of a micro liquid droplet can considerably be improved.

By adopting the above-described liquid detection method, an ink-jet printing apparatus can detect ink discharge failure. Moreover, since recovery operation of a printhead is performed only when a nozzle causing discharge failure is detected, unnecessary ink consumption can be prevented, and the time required for recovery processing can be reduced.

Furthermore, by performing non-discharge compensation printing, image printing can be performed without deteriorating image quality even when a nozzle or several nozzles fail to discharge liquid.

The present invention is not limited to the above embodiments and various changes and modifications can be made within the spirit and scope of the present invention. Therefore, to apprise the public of the scope of the present invention, the following claims are made.

What is claimed is:

1. A liquid detection apparatus comprising:

radiated wave detection device, arranged near a path of transit of a passing liquid or a liquid droplet, that detects a radiated wave radiated from the liquid or the liquid droplet transiting the path and outputs a signal corresponding to the detected radiated wave;

detection device that detects variation of the signal outputted by said radiated wave detection device;

liquid output device that outputs the liquid or the liquid droplet according to a predetermined pattern; and determination device that determines a matching state between a pattern represented by the variation detected by said detection device and the predetermined pattern with which said liquid output device outputs the liquid or the liquid droplet;

wherein it is detected whether or not the liquid or the liquid droplet has passed without contacting the liquid or the liquid droplet transiting the path.

2. The liquid detection apparatus according to claim 1, wherein the radiated wave is an infrared ray.

3. The liquid detection apparatus according to claim 1, wherein said detection device is an infrared ray sensor.

4. The liquid detection apparatus according to claim 1, further comprising measurement device that measures a variation amount detected by said detection device.

5. The liquid detection apparatus according to claim 4, wherein said measurement device measures the variation amount by integrating the values of the signals.

6. The liquid detection apparatus according to claim 1, wherein said determination device determines a matching state between a timing, at which the liquid or the liquid droplet is outputted according to the predetermined pattern, and a timing represented by the variation detected by said detection device.

7. The liquid detection apparatus according to claim 1, wherein said determination device determines a matching state between a cycle, at which the liquid or the liquid droplet is outputted according to the predetermined pattern, and a cycle represented by the variation detected by said detection device.

8. The liquid detection apparatus according to claim 1, wherein said determination device determines a matching state between a number of times of outputting the liquid or the liquid droplet according to the predetermined pattern and a number of times represented by the variation detected by said detection device.

9. The liquid detection apparatus according to claim 4, further comprising device that outputs the liquid or the liquid droplet according to a cycle which corresponds to a time constant of the variation detected by said detection device, wherein said measurement device measures the variation amount, caused by the liquid or the liquid droplet outputted by said device, by integrating the signals detected by said radiated wave detection device and the variations detected by said detection device.

10. The liquid detection apparatus according to claim 1, further comprising heating device that heats the liquid or the liquid droplet prior to the detection of said radiated wave detection device.

11. A liquid detection method of detecting whether or not liquid or a liquid droplet has passed without contacting the liquid or the liquid droplet, comprising:

detecting a wave radiated from the liquid or the liquid droplet using a sensor positioned near a path of transit of the liquid or the liquid droplet;

detecting variation of output value of the sensor;

outputting the liquid or the liquid droplet according to a predetermined pattern; and determining a matching state between a pattern, represented by the variation of output value detected, and the predetermined pattern with which the liquid or the liquid droplet is outputted.

12. The liquid detection method according to claim 11, wherein the radiated wave is an infrared ray.

13. The liquid detection method according to claim 11, wherein the sensor includes an infrared ray sensor.

14. The liquid detection method according to claim 11, further comprising measuring a variation amount of the output value, wherein an amount of the liquid or the liquid droplet passed by is detected without contacting the passing liquid or the liquid droplet.

15. The liquid detection method according to claim 14, wherein the variation amount of the output value is measured by integrating the output values.

16. The liquid detection method according to claim 11, wherein a matching state is determined between a timing, at which the liquid or the liquid droplet is outputted according to the predetermined pattern, and a timing represented by the variation of the output value detected.

17. The liquid detection method according to claim 11, wherein a matching state between a cycle, at which the liquid or the liquid droplet is outputted according to the predetermined pattern, and a cycle represented by the variation of the output value is determined.

18. The liquid detection method according to claim 11, wherein a matching state between a number of times of outputting the liquid or the liquid droplet according to the predetermined pattern and a number of times represented by the variation of the output value is determined.

19. The liquid detection method according to claim 14, further comprising outputting the liquid or the liquid droplet according to a cycle which corresponds to a time constant of output variation of the output value detected, wherein the variation amount of the output value is measured by integrating the output value of the sensor.

20. The liquid detection method according to claim 11, further comprising heating the liquid or the liquid droplet prior to said detecting variation of output value.

21. An ink-jet printing apparatus for printing an image by discharging ink onto a printing medium with an ink-jet head, comprising:

radiated wave detection device that detects a radiated wave radiated from the ink discharged by the inkjet head and outputs a signal corresponding to the radiated wave;

detection device that detects variation of the signal outputted by said radiated wave detection device;

ink discharge control device that discharges ink according to a predetermined pattern; and determination device that determines a matching state between a pattern, represented by the variation detected by said detection device, and the predetermined pattern of discharging the ink;

wherein whether or not the ink has passed is detected without contacting the ink.

22. The ink-jet printing apparatus according to claim 21, wherein the radiated wave is an infrared ray.

23. The ink-jet printing apparatus according to claim 21, wherein said detection device includes an infrared ray sensor.

24. The ink-jet printing apparatus according to claim 21, further comprising measurement device that measures a variation amount detected by said detection device.

25. The ink-jet printing apparatus according to claim 24, wherein said measurement device measures the variation amount by integrating values of the signals.

26. The ink-jet printing apparatus according to claim 21, wherein said determination device determines a matching state between a timing, at which the ink is discharged according to the predetermined pattern, and a timing represented by the variation detected by said detection device.

27. The ink-jet printing apparatus according to claim 21, wherein said determination device determines a matching state between a cycle, at which the ink is discharged according to the predetermined pattern, and a cycle represented by the variation detected by said detection device.

28. The ink-jet printing apparatus according to claim 21, wherein said determination device determines a matching state between a number of times of discharging the ink according to the predetermined pattern and a number of times represented by the variation detected by said detection device.

29. The ink-jet printing apparatus according to claim 24, further comprising ink discharge device that discharges the ink according to a cycle which corresponds to a time constant of output variation detected by said detection device, wherein said measurement devices measures the variation amount by integrating values of the signals from said radiated wave detection device and the variation detected by said detection device.

30. The ink-jet printing apparatus according to claim 21, further comprising heating means for heating the ink prior to the detection of said radiated wave detection means.

31. An ink detection method for an ink-jet printing apparatus which prints an image by discharging ink onto a printing medium with an ink-jet head, said method comprising:

detecting a radiated wave radiated from the ink discharged by the ink-jet head and outputting a value corresponding to the detected radiated wave;

detecting variation of the value of the detected radiated wave, discharging the ink according to a predetermined pattern; and determining a matching state between a pattern, represented by the variation of the values detected, and the predetermined pattern with which the liquid or the liquid droplet is discharged;

wherein whether or not the ink has passed is detected without contacting the ink.

32. The ink detection method according to claim 31, wherein the radiated wave is an infrared ray.

33. The ink detection method according to claim 31, further comprising measuring a variation amount detected, wherein an amount of the ink passed by is detected without contacting the ink.

34. The ink detection method according to claim 31, further comprising:

discharging ink at a predetermined timing; and determining whether or not the predetermined timing matches the variation detected.

35. The ink detection method according to claim 33, wherein the variation amount is measured based on a time period during which the values are within a predetermined range.

36. The ink detection method according to claim 33, wherein the variation amount is measured by integrating the values detected.

37. A liquid detection apparatus for detecting discharge of a liquid or liquid droplet from a liquid discharge device, comprising:

a detection device, arranged near a discharge path of a liquid or liquid droplet discharged from the liquid discharge device, that detects a radiated wave radiated from the liquid or liquid droplet transiting the path and outputs a signal corresponding to the detected radiated wave, wherein said detection device detects the radiated wave without contacting the liquid or liquid droplet;

control means for controlling the liquid discharge device to discharge a liquid or liquid droplet in accordance with a predetermined pattern indicating a driving timing; and determination means for determining a state of discharge of the liquid or liquid droplet based on both the predetermined pattern and a waveform of a signal output from said detection device, when said liquid discharge device is controlled to discharge the liquid or liquid droplet by said control means, in accordance with the predetermined pattern.

38. The apparatus according to claim 37, wherein said determination means comprises a comparator for comparing the waveform of the signal output from the detection device with a reference value and for outputting signals having different levels based on a result of comparison, and wherein said determination means determines the state of discharge of the liquid or liquid droplet based on both the predetermined pattern and a pattern of signals output from the comparator.

39. The apparatus according to claim 38, wherein said determination means determines whether or not the predetermined pattern and the pattern of signals output from the comparator coincide.

40. The apparatus according to claim 37, wherein the radiated wave is an infrared ray and said determination means includes a sensor for detecting the infrared ray.

41. An ink-jet apparatus for discharging ink and printing an image on a printing medium using an ink-jet head which discharges ink in accordance with driving signal, comprising:

a detection device, arranged near a discharge path of the ink discharged from the ink-jet head, that detects a radiated wave radiated from the ink transiting the path and outputs a signal corresponding to the detected radiated wave, wherein said detection device detects the radiated wave without contacting the ink;

control means for controlling the ink-jet head to discharge ink in accordance with a driving signal indicating a predetermined pattern of drive timing; and determination means for determining a state of discharge of the ink based on both the predetermined pattern and a waveform of a signal output from said detection device, when said ink-jet head is controlled to discharge the ink by said control means, in accordance with the predetermined pattern.

42. The apparatus according to claim 41, wherein said determination means comprises a comparator for comparing the waveform of the signal output from the detection device with a reference value and for outputting signals having different levels based on a result of comparison, and wherein said determination means determines the state of discharge of the ink based on both the predetermined pattern and a pattern of signals output from the comparator.

43. The apparatus according to claim 42, wherein said determination means determines whether or not the predetermined pattern and the pattern of signals output from the comparator coincide.

44. The apparatus according to claim 41, wherein the radiated wave is an infrared ray and said determination means includes a sensor for detecting the infrared ray.

45. The apparatus according to claim 41, wherein the ink-jet head is a printhead for discharging ink by applying a heat energy to the ink.

46. A liquid detection method of detecting discharge of a liquid or liquid droplet from a liquid discharge device, comprising the steps of:

detecting a radiated wave radiated from a liquid or liquid droplet transiting a discharge path from the liquid discharge device, wherein the radiated wave is detected from near the path and without contacting the liquid or liquid droplet;

outputting a signal corresponding to the detected radiated wave;

controlling the liquid discharge device to discharge a liquid or liquid droplet in accordance with a predetermined pattern indicating a driving timing; and determining a state of discharge of the liquid or liquid droplet based on both the predetermined pattern and a waveform of the signal output in said outputting step, when the liquid discharge device is controlled to discharge the liquid or liquid droplet in said controlling step, in accordance with the predetermined pattern.

47. An ink-jet method of discharging ink and printing an image on a printing medium using an ink-jet head which discharges ink in accordance with a driving signal, comprising the steps of:

detecting a radiated wave radiated from ink transiting a discharge path of ink discharged from the ink-jet head, wherein the radiated wave is detected from near the path and without contacting the ink;

outputting a signal corresponding to the detected radiated wave;

controlling the ink-jet head to discharge ink in accordance with a driving signal indicating a predetermined pattern of drive timing; and determining a state of discharge of the ink based on both the predetermined pattern and a waveform of the signal output in said outputting step, when said ink-jet head is controlled to discharge the ink in said controlling step, in accordance with the predetermined pattern.

* * * * *